US006978104B2

(12) United States Patent
Jang

(10) Patent No.: US 6,978,104 B2
(45) Date of Patent: Dec. 20, 2005

(54) PAPER FEEDER AND A PRINTER EMPLOYING THE SAME

(75) Inventor: Heung-kyu Jang, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/670,522

(22) Filed: Sep. 26, 2003

(65) Prior Publication Data

US 2004/0091300 A1 May 13, 2004

(30) Foreign Application Priority Data

Oct. 10, 2002 (KR) ..... 10-2002-0061822

(51) Int. Cl.[7] ..... G03G 21/00
(52) U.S. Cl. ..... 399/124; 399/130
(58) Field of Search ..... 399/21, 401, 361, 399/402, 381, 110, 107, 124, 388, 130; 271/186, 271/902; 400/624, 518

(56) References Cited

U.S. PATENT DOCUMENTS 5,329,295 A * 7/1994 Medin et al. ..... 346/25
5,839,014 A * 11/1998 Takahashi et al. ..... 399/21
6,161,930 A * 12/2000 Asano ..... 347/102
6,445,903 B2 * 9/2002 Hashimoto et al. ..... 399/401
6,497,179 B1 * 12/2002 Allen et al. ..... 101/484
6,574,011 B1 * 6/2003 Sato et al. ..... 358/401
6,577,844 B2 * 6/2003 Kamei ..... 399/401
6,785,508 B2 * 8/2004 Jeong ..... 399/401

FOREIGN PATENT DOCUMENTS

JP 04-140763 * 5/2002 ..... G03G 15/00

* cited by examiner

*Primary Examiner*—Daniel J. Colilla
*Assistant Examiner*—Marissa Ferguson
(74) *Attorney, Agent, or Firm*—Stanzione & Kim, LLP

(57) ABSTRACT

A paper feeder of a printer has a plurality of paper feeding paths to feed a printing paper, and a main fed roller feeding the printing paper to an image forming unit of an image forming apparatus. The paper feeding paths are disposed along an outer circumference of the main fed roller and confluent along a connecting conveyance path by the main feed roller. The connecting conveyance path is connected with a main conveyance path which guides the printing paper to the image forming unit of the image forming apparatus. By a single feed roller, the printing paper from the paper feeding cassette in an automatic paper feeding mode, the printing paper from a manual paper feeding tray in a manual paper feeding mode, and the printing paper being inverted and returned in double-sided printing, can be fed to the paper conveyance path efficiently. Because there is no need to prepare a separate feeding apparatus to convey the printing paper according to the respective printing modes, a structure of the printer can be simplified, and an internal space of the printer is reduced. As a result, a compact-sized printer requiring less manufacturing costs can be provided.

23 Claims, 3 Drawing Sheets

PAPER FEEDER AND A PRINTER EMPLOYING THE SAME

CROSS-REFERENCE TO RELATED APPLICATIONS

This application claims the benefit of Korean Patent Application No. 2002-61822 filed with the Korea Industrial Property Office on Oct. 10, 2002, the disclosure of which is incorporated herein by reference.

BACKGROUND OF THE INVENTION

1. Field of the Invention

The present invention relates to a printer, and more particularly, to a paper feeder of a printer which feeds a paper sheet from a paper feeding cassette or a manual paper feeding tray or returns the paper sheet of which one side has been printed in two-sided printing (duplex printing), to a paper conveyance path inside a printer body of the printer.

2. Description of the Related Art

Generally, a printer prints an image, which is formed and developed by a toner at an image forming unit, on a paper sheet which is fed from outside, and thus discharges the printed paper. Accordingly, the printer is generally provided with a paper feeding part which feeds the paper sheet to a paper conveyance path via the image forming unit of a printer body of the printer.

FIG. 1 is a sectional view schematically showing a conventional printing apparatus. A reference numeral 1 denotes a photosensitive belt unit, 2 is an exposure unit for forming a predetermined electrostatic latent image on the photosensitive belt unit 1, 3 is a developing unit for developing the electrostatic latent image of the photosensitive belt with color toners, 4 is a transfer unit for transferring the toner image of the photosensitive belt unit 1 onto a paper sheet, and 5 is a fusing unit for attaching the toner image on the paper sheet with heat and pressure.

The developing unit 3 includes four developers of yellow, magenta, cyan and black, and the transfer unit 4 includes a transfer drum 4-1 and a transfer roller 4-2. The fusing unit 5 includes a pair of fusing rollers 5-1, 5-2.

A main conveyance path 10 is defined inside a printer body of the printing apparatus, extending via the transfer unit 4 and the fusing unit 5 to a paper discharging tray. A paper feeding cassette 11 for a plurality of paper sheets is arranged at a lower side of the printer body. A pickup device 12 is disposed adjacent to the paper feeding cassette 11 and arranged to pick up the paper sheet from the paper feeding cassette 11 and to feed the picked-up paper to the main conveyance path 10.

In the conventional printing apparatus (printer) as constructed above, with a printing start signal input, the electrostatic latent image is formed on the photosensitive belt unit 1 by the exposure unit 2, and the electrostatic latent image is developed by the developing unit 3 and transferred to the transfer drum 4-1. Accordingly, the paper sheet is picked up by the pickup device 12 from the paper feeding cassette 11 and fed to the main conveyance path 10, and as the paper sheet passes between the transfer drum 4-1 and the transfer roller 4-2, the image, which is transferred onto the transfer drum 4-1, is transferred onto the paper sheet. Such transferred image is firmly attached to the paper as the paper sheet passes through the fusing unit 5, and the printed paper sheet is discharged out to the paper discharging tray.

The printers can have various paper storage and feeding means in addition to the paper feeding cassette 11 as mentioned above, such as a manual feeding tray (not shown) which is usually used for multi-purpose printing. The printer also has a paper returning part which inverts the paper printed on one side thereof and returns the paper back to the paper conveyance path.

In a manual paper feeding mode, the paper is placed on the manual feeding tray and fed to the main conveyance path 10 by a separate paper conveyance roller. In double-side printing or duplex printing, after the image is printed on one side of the paper sheet, the paper sheet is returned to the main conveyance path 10 by a separate paper returning device so that another image can be printed on the other side thereof.

In other words, the conventional general printers usually have many devices to feed the paper sheet to the main conveyance path 10, either from the paper feeding cassette 11 or the manual paper feeding tray or from the separate paper returning device for the duplex printing. That is, besides the pickup device and paper conveyance roller, many other paper conveyance rollers are required to feed the paper sheet to the main conveyance path 10.

As a result, a paper conveyance roller for automatic paper feeding, another paper conveyance roller for manual paper feeding, and a returning device for duplex printing are all required to be equipped in one printer, which makes the structure of the printer complex and also unnecessarily bulky. Also, the manufacturing cost of the printer becomes high.

SUMMARY OF THE INVENTION

In an effort to overcome the above and/or other problems as mentioned above, it is an aspect of the present invention to provide a paper feeder of a printer, which is constructed such that paper feeding devices used with automatic feeding, manual feeding and return feeding for duplex feeding, are all realized in a single unit, such as a feed roller, so as to contribute to compactness of the printer and also reduction of manufacturing costs.

Additional aspects and advantages of the invention will be set forth in part in the description which follows and, in part, will be obvious from the description, or may be learned by practice of the invention.

In an effort to achieve the above aspect and/or other features of the present invention, there is provided a paper feeder of a printer which feeds a printing paper to a paper conveyance path via a transfer unit and a fusing unit of the printer, regardless of whether the printing paper is fed from a paper feeding cassette or from a manual paper feeding tray, or whether the paper is inverted and returned for double-side printing.

According to an embodiment of the present invention, a paper feeder of the printer includes a connecting conveyance path which is connected to the main conveyance path inside a printer body of the printer, and a plurality of paper feeding paths branching from the connecting conveyance path. The paper feeder also includes a main feed roller and a sub feed roller. The main feed roller is rotatably disposed on a junction between the connecting conveyance path and the paper feeding paths to feed the printing paper from the respective paper feeding paths to the main conveyance path. The sub feed roller is rotatably disposed in the connecting conveyance path to adjust and align a position of the printing paper which is passed along the connecting conveyance path.

The paper feeding paths include first and second paper feeding paths along which the printing paper from the paper feeding cassette is conveyed in an automatic paper feeding mode, a third paper feeding path along which the printing paper from the manual paper feeding tray is fed, and a fourth paper feeding path along which the inverted printing paper, of which one side has been printed, is conveyed and fed for double-sided printing.

According to the present invention, a paper sensor may be further provided on the connecting conveyance path and between the main feed roller and the sub feed roller, to determine whether the printing paper as conveyed is transparent.

Further, according to the present invention, first, second and third pinch rollers may be additionally provided for a tight contact with outer circumferences of the main feed roller and the sub feed roller to assist the conveyance of the printing paper.

Meanwhile, the respective parts, as mentioned above, may be mounted on a frame of the printer body of the printer (image forming apparatus) directly, or may be mounted on a separate bracket of the printer.

Accordingly, by the single main feed roller, the printing paper from the paper feeding cassette in the automatic paper feeding mode, the printing paper from a manual paper feeding tray in a manual paper feeding mode, and the printing paper being inverted and returned in a double-sided printing mode, can be fed to the paper conveyance path efficiently. Because there is no need to prepare a separate feeding apparatus to convey the printing paper according to the respective printing modes, structure of the printer can be simplified, and an internal space of the printer is reduced. As a result, a compact-sized printer requiring less manufacturing costs can be provided.

According to another aspect of the present invention, an image forming apparatus includes an image forming unit to form a desired image on a printing paper, a main conveyance path to guide the printing paper to the image forming unit, a paper feeding unit comprising at least one paper feeding cassette and a paper feeding tray each storing a plurality of printing paper, and a paper feeder to convey the printing paper toward the main conveyance path. Here, the paper feeder has the construction as described above.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
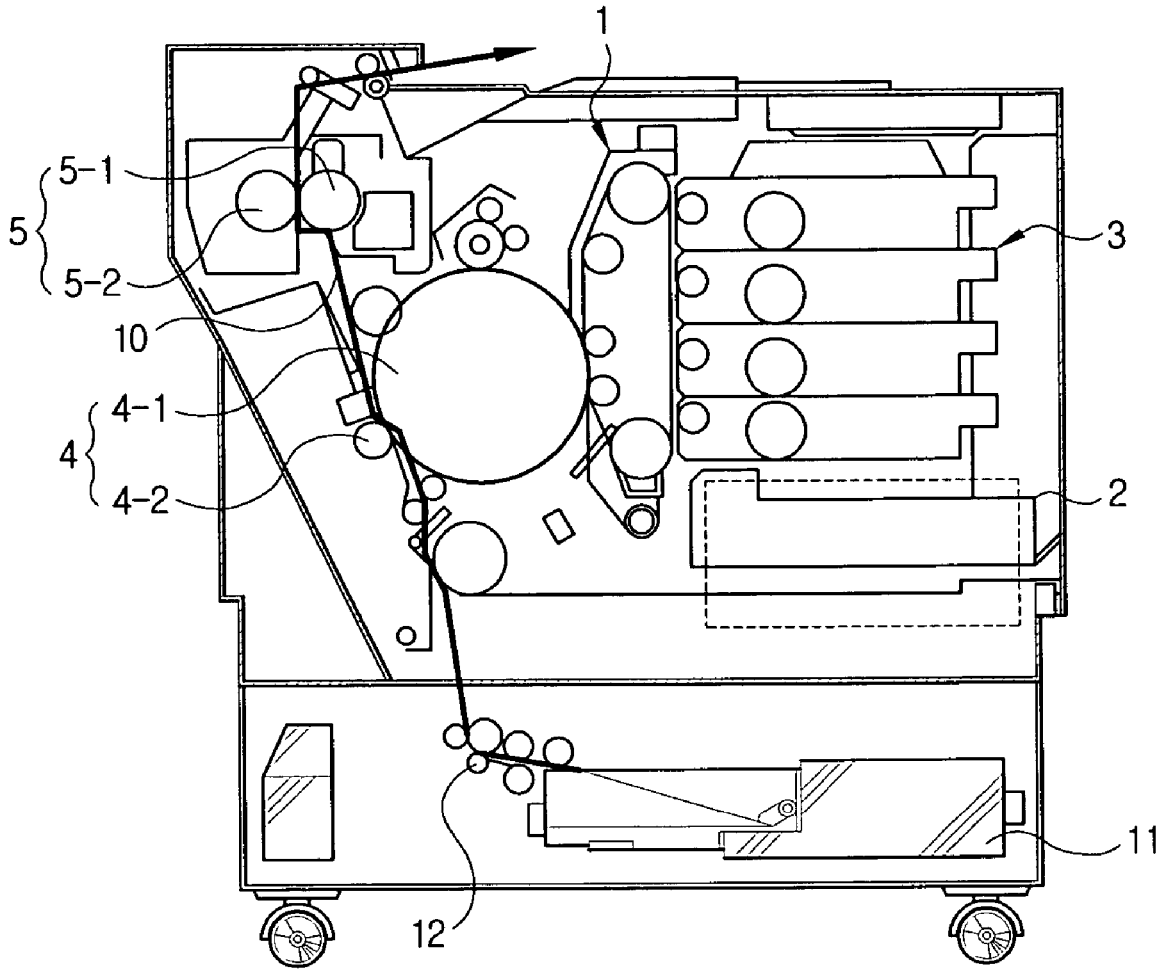
FIG. 1 (PRIOR ART)
FIG. 1 is a schematic sectional view of a printer having a conventional paper feeder.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
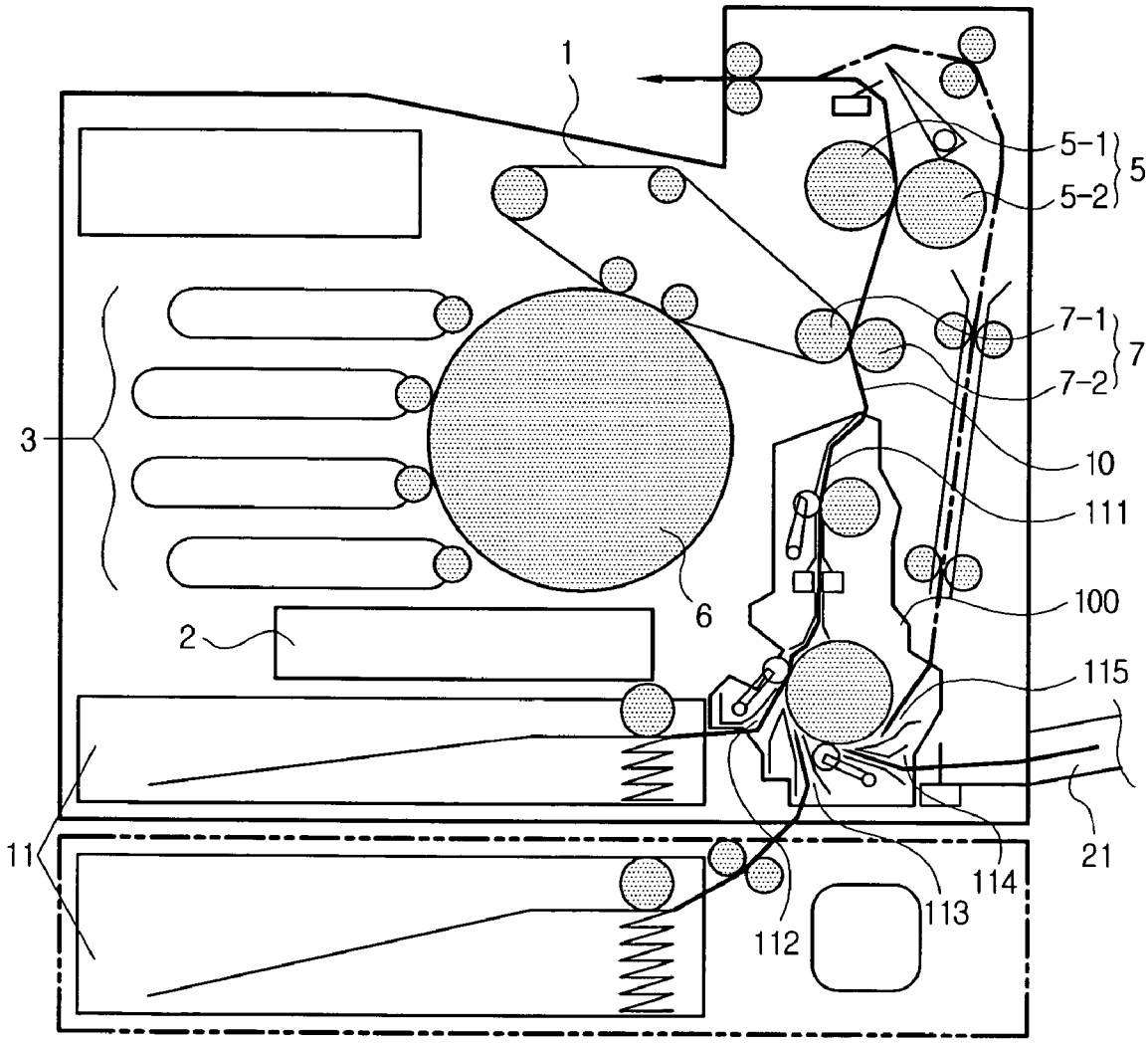
FIG. 2 is a schematic sectional view of a printer having a paper feeder according to an embodiment of the present invention.
Figure 3:
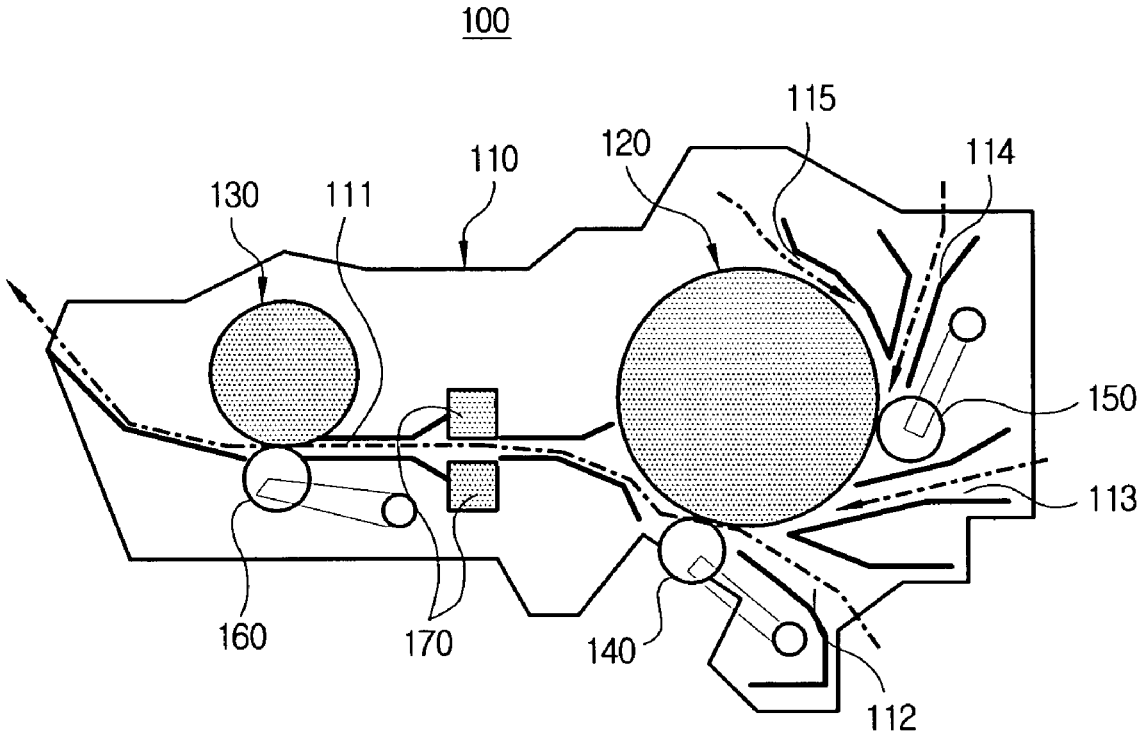
FIG. 3 is a partial cross-sectional view illustrating the paper feeder of the printer shown in FIG. 2.

With reference to FIGS. 2 and 3, a paper feeder 100 of a printer according to an embodiment of the present invention is arranged between an end of a main conveyance path 10 and a paper feeding unit. The main conveyance path 10 is defined inside a printer body of the printer via a transfer unit 7 and a fusing unit 5. The paper feeding unit includes a paper feeding cassette 11 for an automatic paper feeding mode, a manual paper feeding tray 21 for a manual paper feeding mode, and a duplex printing path for double-sided printing. Here, the paper feeding cassette stores a plurality of paper sheets therein and is removably mounted inside the printer body, and a duplex printing path returns a printing paper which is printed on one side thereof for the double-sided printing (duplex printing). Paper sheets, regardless of whether they are placed in the paper feeding cassette 11 or on the manual paper feeding tray 21 or returned for the duplex printing, are all entered into the main conveyance path 10 inside the printer body by the paper feeder 100. Instead of a conventional way of providing a paper feeding roller to feed the paper sheet from the paper feeding cassette 11 to the main conveyance path 10, and another paper feeding roller to feed the paper sheet from the manual paper feeding tray 21 to the main conveyance path 10, and a separate return device to re-feed the one-side printed paper sheet back to the main conveyance path 10, a single unit, i.e., the paper feeder 100 according to the present invention can fulfill the jobs of the above parts efficiently, and this will be described below in greater detail.

The paper feeder 100 according to the present invention includes a main feed roller 120, a sub feed roller 130, a connecting conveyance path 111 and a plurality of paper feeding paths 112, 113,114,115.

The paper feeder 100 can be mounted on a frame of the printer directly or on a separate bracket 110.

The bracket 110 is formed as a metal plate of predetermined shape and size, and one connecting conveyance path 111 and the paper feeding paths 112 to 115 branching from the connecting conveyance path 111 are formed on the bracket 110. The connecting conveyance path 111 may be formed as pairs of guide plates forming a paper guiding path. The connecting conveyance path 111 is connected with one end thereof to the main paper conveyance path 10, and the paper feeding paths 112 to 115 are branched from the other end of the connecting conveyance path 111. Among the paper feeding paths 112 to 115, first and second paths 112 and 113, respectively, convey the paper sheet from the two paper feeding cassettes 11. A third path 114 conveys the paper sheet from the manual paper feeding tray 21, and the fourth path 115 conveys the paper sheet returned to perform duplex printing.

The main feed roller 120 is rotatably disposed at a junction between the connecting conveyance path 111 of the bracket 110 and the paper feeding paths 112 to 115. The main feed roller 120 is formed to have a sufficient size to cover the respective paper feeding paths 112 to 115 and thus to feed every paper sheet received via the respective paper feeding paths 112 to 115 correctly to the connecting conveyance path 111.

The sub feed roller 130 is rotatably disposed on the connecting conveyance path 111 and adjusts or aligns a position of the paper sheet, which is conveyed along the connecting conveyance path 111.

The paper feeder 100 according to the present invention further includes first and second pinch rollers 140 and 150 to rotate in tight contact with the outer circumference of the main feed roller 120, and a third pinch roller 160 for rotating in tight contact with the outer circumference of the sub feed roller 130. The pinch rollers 140, 150 and 160 assist the conveyance of the paper sheets in cooperation with the main and sub feed rollers 120 and 130.

According to the present invention, there may be a paper sensor 170 further provided on the connecting conveyance path 111 to sense whether the conveyed paper sheet is a transparent material or not. More specifically, in the printer using a transparent paper as well as a normal paper, the paper sensor 170 senses whether the paper sheet is the transparent material or not, thus enabling accurate setting of printing conditions for the paper sheet being conveyed. In this case, the printer having multi-paper feeding can be realized.

Hereinbelow, a printing operation and a paper conveyance in the printer, which has the paper feeder constructed as above according to the embodiment of the present invention, will be described in detail.

With an input of a printing command, a laser beam is radiated from the exposure unit 2 in accordance with a video signal to the photosensitive drum 6 to form a predetermined electrostatic latent image on the photosensitive drum 6. The electrostatic latent image is visualized by the developing unit 3 with toners, and the developed image is transferred onto the transfer belt 1. When in the automatic feeding mode, a sheet of printing paper is picked up from the paper feeding cassette 11 and fed to the first paper feeding path 112. The paper is continuously conveyed to the connecting conveyance path 111 by the main feed roller 120 and fed to the main conveyance path 10 by the sub feed roller 130.

When the paper passes between the transfer roller 7-1 and the backup roller 7-2, the toner image on the transfer belt 1 is transferred onto the paper. Then the paper passes through the fusing unit 5 to have the transferred image fixed thereon, and is discharged out to the paper discharging tray.

If the manual feeding mode is selected to perform the printing operation, a sheet of paper is fed from the manual feeding tray 21 to the third paper feeding path 114, and as the main feed roller 120 is rotated, the paper is conveyed to the connecting conveyance path 111 and fed to the main conveyance unit 10.

In the duplex printing, the printing paper, having an image printed on one side thereof, is returned to the fourth paper feeding path 115, conveyed to the connecting conveyance path 111 by the main feed roller 120 and fed back to the main conveyance path 10.

In the printing operation with a transparent printing paper, the transparent printing paper is placed on the manual paper feeding tray 21. The transparent paper is fed to the third paper feeding path 114, and to the connecting conveyance path 111 by the main feed roller 120, and to the main conveyance path 10. When the transparent paper is passed along the connecting conveyance path 111, the paper sensor 170 senses that the transparent paper is being used, and as a result, the printer performs the printing operation under image forming conditions which are appropriate for the transparent paper.

As described above, with the paper feeder according to the embodiment of the present invention, whether the paper is picked up from the paper feeding cassette, or from the manual paper feeding tray, or returned for the duplex printing, all of the printing paper is efficiently fed to the main conveyance path 10 by a single feed roller 120. Because many parts, such as a paper conveying roller, which were required conventionally for the respective printing modes, can be omitted, the printer can be compact-sized and have a simpler construction. In other words, the compact-sized printer requiring less manufacturing costs can be provided.

Although a few preferred embodiments of the present invention have been described, it will be understood by those skilled in the art that the present invention should not be limited to the described preferred embodiments, but various changes and modifications can be made within the spirit and scope of the present invention as defined by the appended claims and their equivalents.

What is claimed is:

1. A paper feeder of an image forming apparatus having an image forming unit to form an image on a printing paper, comprising:

a plurality of paper feeding paths along which a printing paper is fed;

a main conveyance path disposed between an image forming unit and the paper feeding paths; and a main feed roller to convey the printing paper from the paper feeding paths to the image forming unit of the image forming apparatus through the main conveyance path; and a connecting conveyance path formed between the main conveyance path and the outer circumference of the main feed roller to guide the printing paper, which is conveyed from the paper feeding paths along the outer circumference of the main feed roller, to the main conveyance path, wherein the paper feeding paths are disposed along an outer circumference of the main feed roller.

2. The paper feeder of claim 1, wherein the paper feeding paths are confluent along the connecting conveyance path by the main feed roller, and the connecting conveyance path is connected to the main conveyance path which guides the printing paper to the image forming unit.

3. The paper feeder of claim 1, further comprising:

a sub feed roller rotatably disposed on the connecting conveyance path between the main feed roller and the main conveyance path to feed the printing paper, which is conveyed by the main feed roller along the connecting conveyance path, to the image forming unit through the main conveyance path.

4. The paper feeder of claim 3, wherein the sub feed roller adjusts and aligns a position of the printing paper which is conveyed along the connecting conveyance path.

5. The paper feeder of claim 4, further comprising:

a paper sensor disposed on the connecting conveyance path and between the main feed roller and the sub feed roller to determine whether the printing paper being conveyed is a transparent material.

6. The paper feeder of claim 3, further comprising:

a pinch roller to assist the conveyance of the printing paper with the outer circumference of the sub feed roller.

7. The paper feeder of claim 1, further comprising:

a first pinch roller disposed in a first exit part of the paper feeding paths to feed the printing paper with the outer circumference of the main feed roller; and a second pinch roller disposed at second and third exit parts of the paper feeding paths to feed the printing paper with the outer circumference of the main feed roller.

8. The paper feeder of claim 1, wherein the paper feeding paths comprises a first, a second, and a third paper feeding paths, and the first paper feeding path comprises:

a cassette conveyance path to guide the printing paper fed from at least two paper feeding cassettes to a first portion of the outer circumference of the main feed roller.

9. The paper feeder of claim 8, wherein the second paper feeding path comprises:

a tray conveyance path to guide the printing paper fed from a manual paper feeding tray to a second portion of the outer circumference of the main feed roller.

10. The paper feeder of claim 9, wherein the third paper feeding path comprises:

a return conveyance path along which the printing paper is returned to a third portion of the outer circumference of the main feed roller, to provide double-sided printing.

11. The paper feeder of claim 1, wherein:

the paper feeding paths comprises a first, a second, and a third paper feeding paths; and the first paper feeding path comprises a first and a second sub-paths having a first exit part disposed on a first portion of the outer circumference of the main feed roller to guide the printing paper fed from a first and a second paper feeding cassettes to the first portion of the outer circumference of the main feed roller, respectively, the second paper feeding path comprises a tray conveyance path having a second exit part disposed on a second portion of the outer circumference of the main feed roller to guide the printing paper fed from a manual paper feeding tray to the second portion of the outer circumference of the main feed roller, and the third paper feeding path comprises a return conveyance path having the third exit part disposed on a third portion of the outer circumference of the main feed roller to guide the printing paper fed from the main conveyance path to the third portion of the outer circumference of the main feed roller to provide double-sided printing.

12. The paper feeder of claim 1, wherein the paper feeding paths comprise a first, a second, and a third paper feeding paths, and the first, second, and third paper feeding paths further comprise:

a first, a second, and a third exits disposed on a first, a second, and a third portion of the outer circumference of the main feed roller, respectively.

13. A paper feeder of an image forming apparatus having an image forming unit to form an image on a printing paper, comprising:

a main feed roller conveying a printing paper to an image forming unit of an image forming apparatus through a main conveyance path;

a connecting conveyance path connected between the main conveyance path and the main feed roller to convey the printing paper from the main feed roller to the main conveyance path;

a plurality of paper feeding paths disposed along an outer circumference of the main feed roller, and being confluent along the connecting conveyance path by the main feed roller;

a sub feed roller rotatably disposed on the connecting conveyance path to adjust and align a position of the printing paper which passes along the connecting conveyance path; and first, second and third pinch rollers being in tight contact with outer circumferences of the main feed roller and the sub feed roller to assist the conveyance of the printing paper, wherein the paper feeding paths comprise, first and second paper feeding paths disposed on first and second portions of the outer circumference of the main feed roller to feed the printing paper from first and second paper feeding cassettes to the first and second portions of the outer circumference of the main feed roller, a third paper feeding path disposed on a third portion of the outer circumference of the main feed roller to feed the printing paper from a manual paper feeding tray to the third portion of the outer circumference of the main feed roller, and a fourth paper feeding path disposed on a fourth portion of the outer circumference of the main feed roller to feed the printing paper returned from a return path to the fourth portion of the outer circumference of the main feed roller to provide double-sided printing.

14. An image forming apparatus comprising:

an image forming unit to form a desired image on a printing paper;

a main conveyance path to guide the printing paper to the image forming unit;

a paper feeding unit comprising at least one paper feeding cassette and a paper feeding tray each storing a plurality of printing paper; and a paper feeder to convey the printing paper toward the main conveyance path, the paper feeder comprising at least three paper feeding paths along which the printing paper fed from the paper feeding unit is guided, and a main feed roller to convey the printing paper from the at least three paper feeding paths to the image forming unit through the main conveyance path, wherein the at least three paper feeding paths are disposed along at least three portions of an outer circumference of the main feed roller, and the paper feeder further comprises a connecting conveyance path along which the at least three paper feeding paths are confluent by the main feed roller, the connecting conveyance path being connected with the main conveyance path.

15. The image forming apparatus of claim 14, wherein the paper feeder further comprises:

a sub feed roller rotatably disposed on the connecting conveyance path to adjust and align a position of the printing paper which passes along the connecting conveyance path.

16. The image forming apparatus of claim 15, wherein the paper feeder further comprises:

a paper sensor disposed on the connecting conveyance path and between the main feed roller and the sub feed roller to determine whether the printing paper being conveyed is transparent.

17. The image forming apparatus of claim 15, further comprising:

a pinch roller to assist the conveyance of the printing paper by rotating in tight contact with an outer circumference of the sub feed roller.

18. The image forming apparatus of claim 14, further comprising:

a pinch roller to rotate in tight contact with the outer circumference of the main feed roller to feed the printing paper from the at least three paper feeding paths to the image forming unit through the main conveyance path, and disposed at an exit part of one of the at least three paper feeding paths.

19. The image forming apparatus of claim 14, wherein the three portions comprise first, second, and third portions disposed to be spaced-apart from one another along the outer circumference of the main feed roller, the at least three paper feeding paths comprise:

a cassette conveyance path to guide the printing paper fed from at least one paper feeding cassette to the first portion of the outer circumference of the main feed roller.

20. The image forming apparatus of claim 19, wherein the at least three paper feeding paths further comprise:

a tray conveyance path to guide the printing paper fed from a manual paper feeding tray to the second portion of the outer circumference of the main feed roller, the second portion disposed between the first portion and the third portion.

21. The image forming apparatus of claim 19, wherein the at least three paper feeding paths further comprise:

a return conveyance path to guide the printing paper returned from a return path to the third portion of the outer circumference of the main feed roller to provide double-sided printing.

22. The image forming apparatus of claim 14, wherein the three portions comprise first, second, and third portions disposed to be spaced-apart from one another along the outer circumference of the main feed roller in order, and the at least three paper feeding paths further comprise:

a tray conveyance path to guide the printing paper fed from a manual paper feeding tray to the second portion of the outer circumference of the main feed roller.

23. The image forming apparatus of claim 14, wherein the at least three paper feeding paths further comprise:

a cassette conveyance path to guide the printing paper fed from at least one paper feeding cassette to the outer circumference of the main feed roller;

a tray conveyance path to guide the printing paper fed from a manual paper feeding tray to the outer circumference of the main feed roller; and a returning conveyance path along which the printing paper is returned to the outer circumference of the main feed roller to provide double-sided printing.

* * * * *